US011046103B2

(12) United States Patent
Patel

(10) Patent No.: US 11,046,103 B2
(45) Date of Patent: Jun. 29, 2021

(54) ROUND CORNER CUTTING MACHINE FOR EXERCISE NOTE BOOKS

(71) Applicant: Udaykumar Chhabildas Patel, Gujarat (IN)

(72) Inventor: Udaykumar Chhabildas Patel, Gujarat (IN)

( * ) Notice: Subject to any disclaimer, the term of this patent is extended or adjusted under 35 U.S.C. 154(b) by 0 days.

(21) Appl. No.: 16/617,605

(22) PCT Filed: Jun. 1, 2018

(86) PCT No.: PCT/IN2018/050353
§ 371 (c)(1),
(2) Date: Nov. 27, 2019

(87) PCT Pub. No.: WO2018/220651
PCT Pub. Date: Dec. 6, 2018

(65) Prior Publication Data

US 2020/0180340 A1 Jun. 11, 2020

(30) Foreign Application Priority Data

Jun. 3, 2017 (IN) ..... 201721019533

(51) Int. Cl.
*B42C 19/08* (2006.01)
*B42C 5/02* (2006.01)

(52) U.S. Cl.
CPC ..... *B42C 19/08* (2013.01); *B42C 5/02* (2013.01)

(58) Field of Classification Search
CPC ..... B42C 19/08; B42C 5/02
USPC ..... 412/1, 9, 16, 25, 32
See application file for complete search history.

(56) References Cited

U.S. PATENT DOCUMENTS 5,022,297 A * 6/1991 Hommes ..... B26D 3/10 83/255
2012/0183374 A1* 7/2012 Fuchs ..... B42B 5/08 412/7

FOREIGN PATENT DOCUMENTS

EP 1832437 9/2007

OTHER PUBLICATIONS

International Search Report for corresponding PCT Application No. PCT/IN2018/050353 dated Oct. 2, 2018.

* cited by examiner

*Primary Examiner* — Justin V Lewis
(74) *Attorney, Agent, or Firm* — Caesar Rivise, PC

(57) ABSTRACT

The present invention relates to round corner cutting machine that comprises 5 pairs of suckers (116), each pair of sucker (116) grips single book and middle sucker (116) being located between pairs of sucker (116) that grip middle book. Here, position of each pair of sucker (116) is adjusted by adjusting position of guide blocks though adjustable links (107, 108). Further, distance between suckers (116) of each pair is adjusted by sliding the sucker cups (113) 10 within slot (112) of guide block so that according to size of books, the position of sucker is defined such that each book is gripped by one pair of sucker. After gripping, each pair of sucker (116) is separated linearly so that books are separated from their partition line. Said separated books are conveyed to back stopper assembly (3) where books are properly positioned and then 15 corner cutting assembly carry the corner cutting of books.

10 Claims, 6 Drawing Sheets

ROUND CORNER CUTTING MACHINE FOR EXERCISE NOTE BOOKS

CROSS REFERENCE TO RELATED APPLICATIONS

This national phase application claims the benefit under 35 U.S.C. 071 of PCT/IN2018/050353, filed Jun. 1, 2018, and whose entire disclosure is incorporated by reference herein.

FIELD OF THE INVENTION

The present invention relates to a round corner cutting machine for exercise note books and more particularly, it relate to an improved round corner cutting machine that is configured to accommodate numbers of sharp cornered books of different size and to round corner cutting of accommodated sharp cornered bound instruction books.

BACKGROUND AND PRIOR ART OF THE INVENTION

Generally, books are manufactured with sharp corner. Said sharp cornered products may hurt if it is not properly handled by the user. Hence, from the safety point of view, it is required to make it round corner to avoid injury occurred during improper handling.

In order to solve aforesaid problem, it is required to remove sharpness of the corner and converting into round corner. For round corner cutting of books, various kinds of machine have been developed. One such round corner cutting machine is disclosed in the Chinese patent No. CN202846595. Said machine relates to a round corner bound instruction book cutting machine which is used for cutting a bound instruction book one-time in a round-corner mode.

However, such conventional machines have some limitations. In conventional round corner cutting machine, round corner making configuration is specifically designed for same size of book. There is no mechanism for adjustment to accommodate different size of books. Further, due to design limitation, multiple numbers of books can not be accommodated. Further, for accommodating different size of books, such machine requires plenty of manual intervention and more set up time that affects the overall production.

OBJECT OF THE INVENTION

The main object of present invention is to provide an improved round corner cutting machine that performs round corner cutting of the books by overcoming the limitations associated with conventional machines.

Another object of the present invention is to provide an improved corner cutting machine that comprises a simplified mechanism for separating the books from one another from their side edges.

Further object of the present invention is to provide an improved round corner cutting machine that has simplified mechanism for adjustment to accommodate different size of books.

One more object of the present invention is to provide an improved round corner cutting machine that is capable of performing round corner cutting of the multiple books simultaneously.

SUMMARY OF THE INVENTION

The present invention relates to an improved round corner cutting machine that comprises a book separator sucker assembly for separating the adjacent sharp corner books from their partition line, a book gripping assembly configured for griping the book along a lateral edge and conveying the books towards the book separator assembly and a back stopper assembly, the back stopper assembly for adjusting the position of the separated sharp cornered book and a corner cutting assembly for performing corner cutting operation onto the books positioned by the book stopper assembly.

Said book separator sucker assembly comprises linearly arranged sucker mounting linear guide blocks, a cam operated lever being connected to a cam shaft through an eccentric bracket, extendable connecting links, one end of each said connecting link is connected to the lever and another end of each link is connected to the guide blocks through blocks, said lever enables the guide blocks to linearly move along with the rotation of the cam shaft through connecting links, pairs of sucker cups and a middle sucker cup. Each said guide block is configured with two extended adjustment slots, each said guide block is connected with pair of sucker cups by securing the sucker cup through the adjustment slot by fastening means. Each said sucker cup is equipped with a sucker for griping the books. Here, according to size of book, the distance between suckers of each pair is adjusted by loosing the securing means and sliding the sucker cups within the adjustment slots such that each book is gripped by a pair of sucker. Each said sucker is connected with the vacuum pump so that when the book will be placed on the pair of suckers, the vacuum is created into each sucker. After gripping the books, each pair of suckers is moved linearly along with the movement of the guide blocks so that the books are separated from their partition line. Then, the separated book will be conveyed towards the book separator assembly where the each separated book will accurately positioned and the, corner cutting operation of each book will be carried by the corner cutting assembly. Thus, the round corner cutting machine is improved by configuring the accommodation of books of different size with simple mechanism and perform corner cutting operation on multiple books simultaneously that leads to increase in overall production.

BRIEF DESCRIPTION OF THE DRAWINGS

Further objects, advantages and features of the apparatus according to the invention will be apparent to those skilled in the art from the following detailed description of a particular embodiment, given by say of a non-limiting example, with reference to the accompanying drawings, wherein.

DETAIL DESCRIPTION OF THE INVENTION

Figure 1:
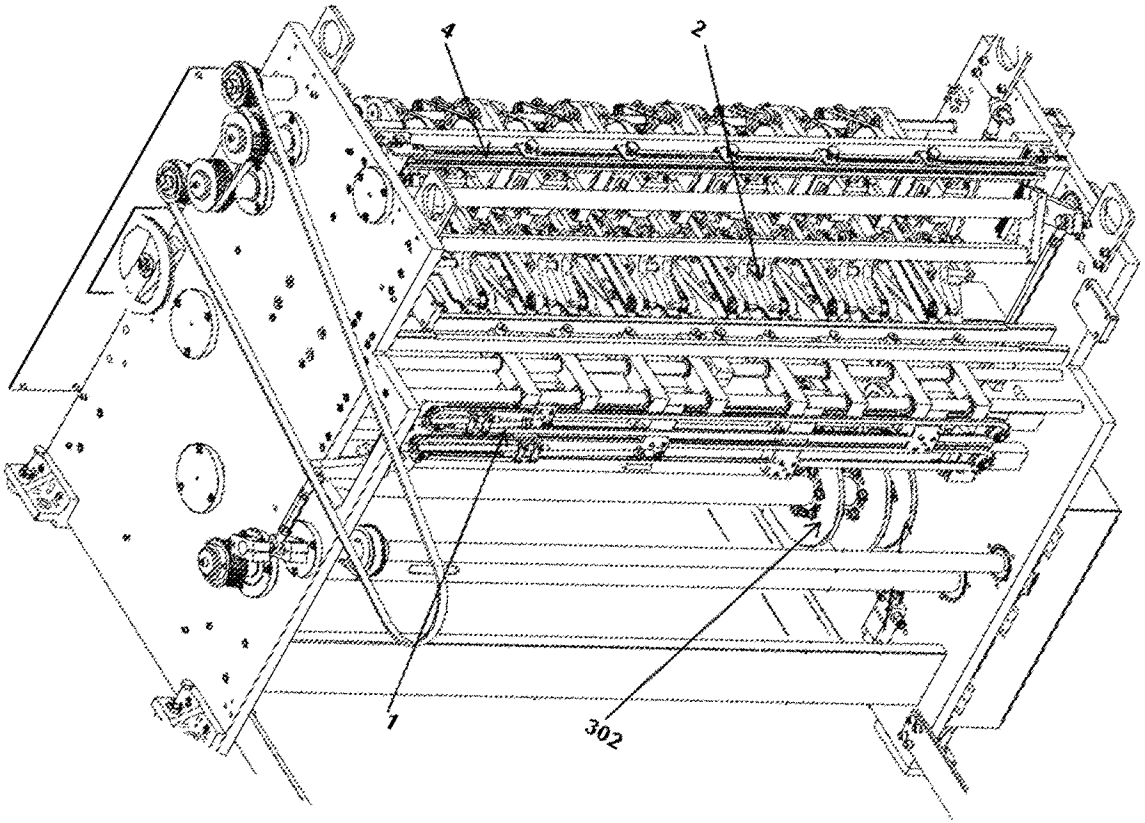
FIG. 1 depicts a perspective view of the round corner cutting machine according to present invention.

Before explaining the present invention in detail, it is to be understood that the invention is not limited in its application to the details of the construction and arrangement of parts illustrated in the accompany drawings. The invention is capable of other embodiments, as depicted in different figures as described above and of being practiced or carried out in a variety of ways. It is to be understood that the phraseology and terminology employed herein is for the purpose of description and not of limitation.

Before explaining the present invention, it is to be noted that the round corner cutting machine according to present invention is described herein by implying that said machine installed in the reel to book binding machine. However, it is within the scope of present invention to utilize said machine independently. It is to be also noted that, in the drawing, identical reference number identify similar element and acts. In book binding machine, the numbers of sharp cornered books (i.e. 3 ups, 4 ups, 5 ups etc.) are prepared and conveyed towards the round corner cutting operation. Initially, said sharp cornered books are adjacent to each other at their edges. Hence, to accommodate said books, these books are required to be separated from the partition line (B) (shown in FIG. 4*a*, 4*b*, 4*c*). The round corner cutting machine according to present invention is configured to perform separation of books as well as round corner cutting of the separated books.

Figure 2:
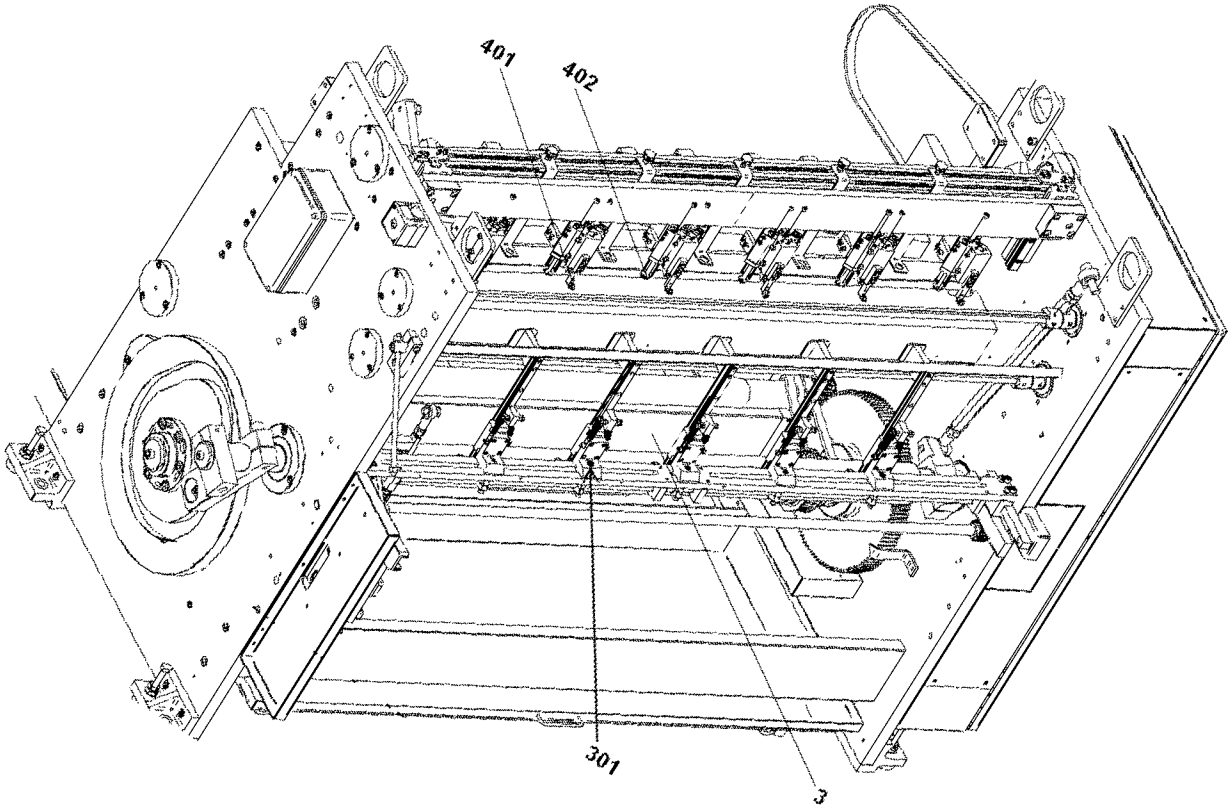
FIG. 2 shows the partial perspective view of the round corner cutting machine according to present invention.

Now as illustrated in FIGS. 1 and 2, the round corner cutting machine according to present invention mainly comprises a books separator sucker assembly (1) to separate out the adjacent sharp cornered books from partition line (B) for easy entry into next unit, a book gripper assembly (2) configured for griping and placing sharp cornered book onto the book separator sucker assembly (1) and conveying the books towards next unit after separation of books, a book stopper assembly (3) (FIG. 2) for adjusting the position of the separated book and a corner cutting assembly (4) for performing corner cutting of separated books.

FIG. 3 illustrates the diagrams for comprehensive view of the book separator sucker assembly (1). Now as shown in FIGS. 3*a* and 3*b*, said book separator sucker assembly (1) comprises linearly arranged T-shaped linear guide sucker mounting blocks (100, 101, 102, 103), a cam operated lever (104) being connected to a cam shaft (105) through an eccentric bracket (106), extendable connecting links (107, 108), the length of each said link (107, 108) is adjusted by loosing bolts (107*a*, 108*a*), one end of each said connecting link (107, 108) is connected to the lever (104) at point (P1, P2) respectively and another end of each link (107, 108) is respectively connected to the guide blocks (100, 101) through bolts (109), said guide blocks (100) and (103) are connected with each other and the guide blocks (101) and (102) are connected with each other through chain sprocket mechanisms (110) and (111) respectively. When said cam shaft (105) is operated, the lever (104) is moved up and down through which said connecting links (107, 108) enable the guide blocks (100, 101) respectively to linearly displace. Thus, when the guide block (100) is moved by said link (107), the guide block (103) will also be moved in the opposite direction at an equal distance by the chain sprocket mechanism (110). Likewise, when the guide block (101) is moved by the link (108), the guide block (102) will also be moved in the opposite direction at an equal distance by the chain sprocket mechanism (111). For example, when the guide block (101) is moved for 30 mm from the centre line (C), the guide block (102) will be also be moved at an equal distance i.e. 30 mm but in opposite direction from the centre line (C). Same mechanism is applied in case of the blocks (100) and (103). Here, the configuration of said links (107, 108) and the eccentric bracket (106) is such that when guide blocks (101, 102) will be moved 30 mm, the guide blocks (100, 103) will be moved 60 mm from the center line (C). Likewise, when the guide blocks (101, 102) will be moved 15 mm, the guide blocks (100, 103) will be moved 45 mm from the center line (C). Said movement of the guide blocks (100, 101, 102, 103) enables the books to separate from their partition line (B) as discuss below in details.

The displacement of the sucker mounting guide blocks (100, 101, 102, 103) are depends on the configuration of the eccentric bracket (106). Now as shown in FIG. 3*d*, Said eccentric bracket (106) comprises a centre hole (106*a*) and a side hole (106*b*). Said cam shaft follower (105) is connected with the eccentric block (106) at its end through the side hole (106*b*) and the lever (104) is connected with the bock (106) at its one end through the center hole (106*a*). Said eccentric bracket (106) is rotated with respect to the side center (106*b*) along with the rotation of cam shaft (105). Here, a distance (A) between the centre hole (106*a*) and the side hole (106*b*) is configured in accordance with displacement of the guide blocks (100, 101, 102, 103) during separation of books.

Figure 3A:
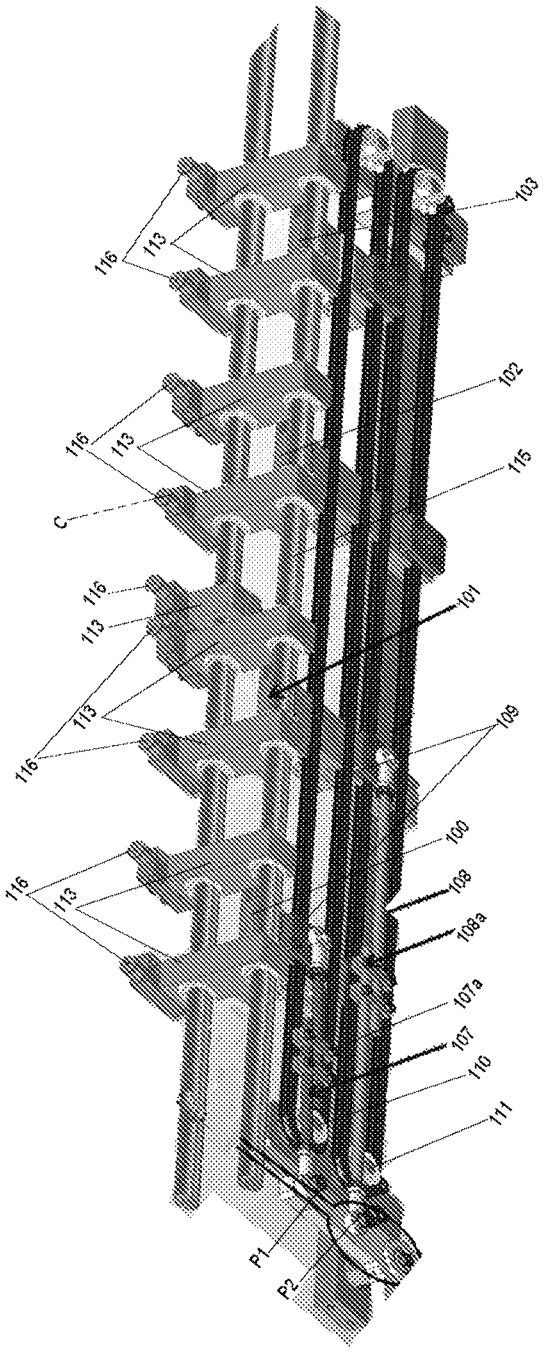
FIG. 3*a*, 3*b*, 3*c* shows the perspective view the book separator sucker assembly according to present invention.
Figure 3B:
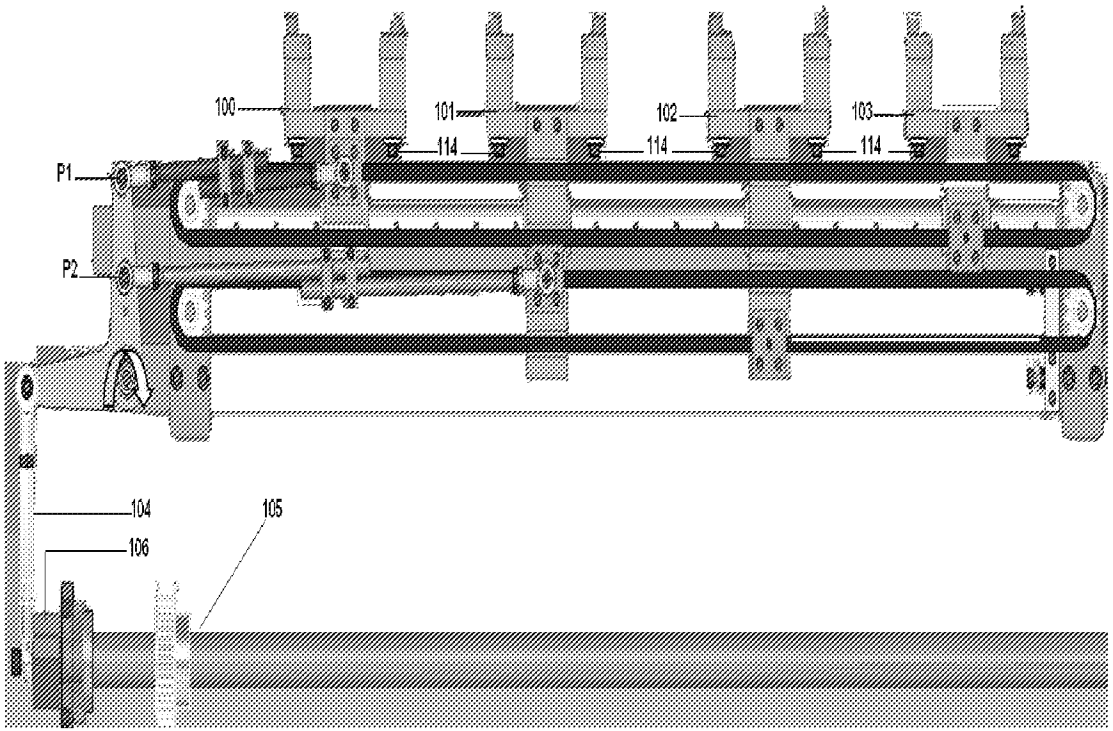
Figure 3C:
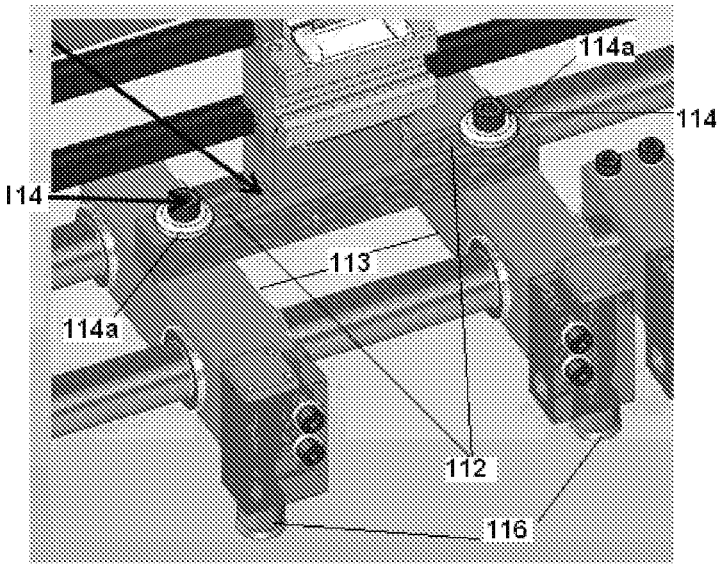
Figure 3D:
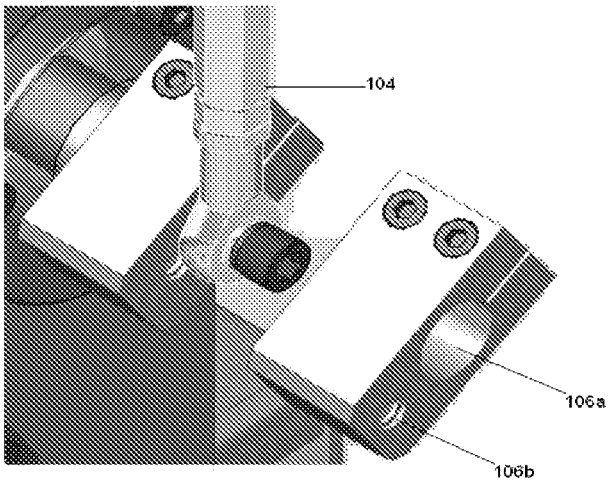
FIG. 3*d* shows the perspective view of the eccentric bracket.

Referring continuous with FIG. 3*a* and FIG. 3*c*, each said guide bock (100, 101, 102, 103) is configured with two extended adjustment slots (112). A sucker cup (113) is fastened on both sides of flat surface of each T shaped guide block through a fastening means (114) so that each guide block is connected with pair of sucker cup (113). In FIGS. 3*a* and 3*b*, there is shown 4 sets (4 pairs) of sucker cups (113) and each guide block is coupled with pair of sucker cup (113). Said fastening means (114) is extended from the sucker cup (113) through the adjustable hole (112) and is secured at its end through a bolt (114*a*) so that each said guide block (100, 101, 102, 103) is anchored with the pair of sucker cup (113) as shown in FIG. 3*c*. Further, said suckers cups (113) are slidably supported through bars (115). For smooth sliding of said sucker cups on the bar, bearings or bushes are utilized. Each said sucker cup (113) is equipped with a sucker (116) which is connected to the vacuum pump (not shown) through valve and said valve maintain the on/off of vacuum. Thus, each guide block (100, 101, 102, 103) is connected with a pair of sucker (116) as shown in FIGS. 3*a* and 3*b*. Here, each pairs of sucker (116) grips a single book by generating vacuum therein through the vacuum pump during separating process. Further, one extra middle sucker cup (113) with a sucker (116) is mounted on the bar (115) with respect to centre line (C) such that it divides equal pairs of sucker cup (113) at it's both the side. Said middle sucker cup (113) is operated to grip the middle book in position in case of separation of odd numbers (i.e. 3 and 5) of book. However, In case of separation of even numbers of books, vacuum connection of the middle sucker (116) is disconnected.

Now as shown in FIG. 3*c*, based on the size of the books, the distance between two paired sucker cups (113) is adjusted by sliding the sucker cups (113) in the adjustment hole (112) by losing the bolt (114*a*) such that one book having 2 number of suckers (116) and after adjusting the position of the sucker cups (113), said bolt (114*a*) is tighten. Further, according to size and numbers of books to be separated, the position of guide blocks (100, 101, 102, 103) are also required to be set. In order to achieve this object, the length of said links (107, 108) is adjusted by loosing the bolts (107*a*, 108*a*) and also a bolt (109) is loosen for sliding the guide blocks (100, 101, 102, 103) till one book is having pair of sucker (116) and once such position of each guide block is achieved, said bolts are secured. Along with the movement of the linear guide blocks (100, 101, 102, 103) as discussed above, the pairs of sucker cups (113) and hence pairs of suckers (116) connected with corresponding guide blocks are also slide along the bars (115) so that the books gripped by said suckers are also separated from their partition line along with separation of pairs of suckers. Thus, according to size of books, user can set the position of pair of suckers (116) such that each book is gripped by pair of suckers (116). Thus, the position of suckers (116) and guide blocks (100, 101, 102, 103) can easily be adjusted according to the size of books to be accommodated. Further, by increasing the numbers of pair of sucker cups, the numbers of books to be accommodated can also be increased. Here, the middle sucker (116) is fixedly supported through the bar (115).

It is to be noted that according to position of sucker cups and linear guide, the position of books stopper assembly and corner cutter assembly are also required to be set. Further, in present embodiment, pairs of suckers are utilized for gripping the books during separation. However, it is within the scope of present invention to utilize only single sucker for griping a single book.

Said book stopper assembly (3) comprises a back stopper (301), at each back stopper (301) the separated book is stopped, a front jogger cam (302) (FIG. 1) and a side jogger cam (not shown) for adjusting and positioning the books accurately once the book is stopped at the back stopper (301) so that the corner cutting operation is accurately carried out. According to the numbers of books to be accommodated, such book stopper assemblies are linearly arranged such that each book is operated by a single book stopper assembly.

Said corner cutting assembly (4) comprises a top movable knife (401) (FIG. 2) and a bottom stationary knife (not shown) for performing corner cutting operation on the book. When the separated book is adjusted in accurate position by said back stopper assembly (3), the product (book) is sensed by sensing means that actuate the corner cutting assembly (4). During corner cutting operation, a book holder (402) (FIG. 2) holds the book and the corner cutting of book is carried out by said top and bottom knife. The radius of corner cutting portion of the book can be changed by changing the top and bottom knife. According to the numbers of books to be accommodated, such corner cutting assemblies are linearly arranged such that corner cutting of each book is done by the single corner cutting assembly (4).

The operation of the round corner cutting machine according to present invention is divided in two modes: first if the numbers of books are even and second, if number of books are odd. For the sake of understanding, in present embodiment, the corner cutting machine is configured to accommodate 3, 4, and 5 no. of books. Initially, the positions of pair of suckers (116) and the guide blocks (100, 101, 102, 103) are pre-adjusted according to the size and numbers of books such that each book is positioned on pair of suckers (116) except that in case of separation of odd numbers of book, the middle book will be placed on the middle sucker.

Figure 4A:
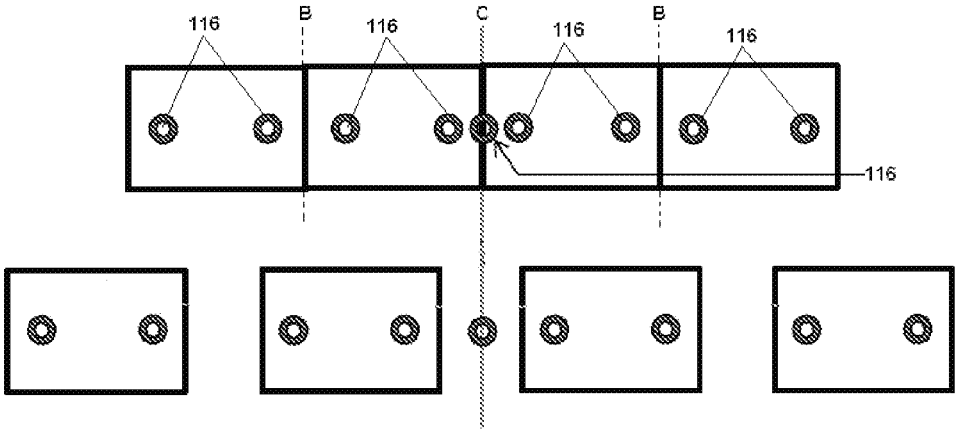
FIG. 4*a* shows the position of suckers and books before separation and after separation in case of even numbers of books.

In first mode, as shown in FIG. 4*a*, four numbers of books are linearly conveyed towards pairs of sucker (116) through their corresponding book griping assemblies (2). Said book gripping assemblies (2) will place the sharp cornered books on the suckers (116) such that each book is placed on the pair of suckers (116). Initially, as shown in FIG. 4*a*, the edges of each book adjacent to its nearby book at petition line (B). After placing of books on the pairs of suckers (116), vacuum is generated in each sucker (116) by the vacuum pump so that each pair of sucker (116) grip and hold a single book. After gripping by suckers (116), the cam operated lever (104) is operated through the cam shaft (105). Said lever (104) will linearly move each guide block (100, 101, 102, 103) by using connecting links (107, 108) and said chain sprocket mechanism (110, 111). Along with the movement of the guide blocks (100, 101, 102, 103), each pair of sucker cups (113) and hence the pair suckers (116) will also be moved linearly. Thus, the pairs of suckers (116) are separated from each other whereby the books gripped/sucked by said pairs are also separated from their partition line (B) as shown in FIG. 4*a*. During this mode, the vacuum connection of the middle sucker (116) is kept in OFF condition. During separation, the book grippers (2) remain in OFF condition and after separation, said gripping assembly (2) grips the corresponding books again and feed the book towards the back stopper (301).

Figure 4B:
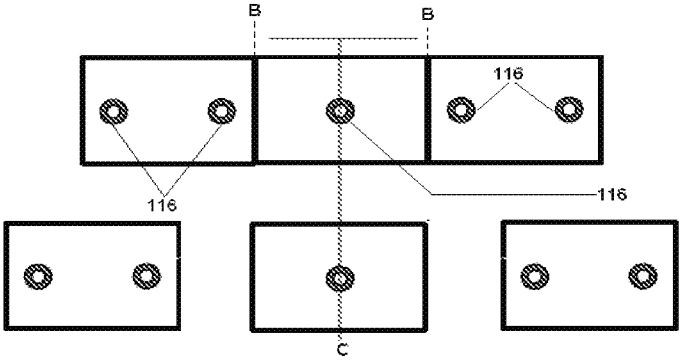
FIGS. 4*b* and 4*c* shows the position of suckers and books before separation and after separation in case of odd numbers of books.
Figure 4C:
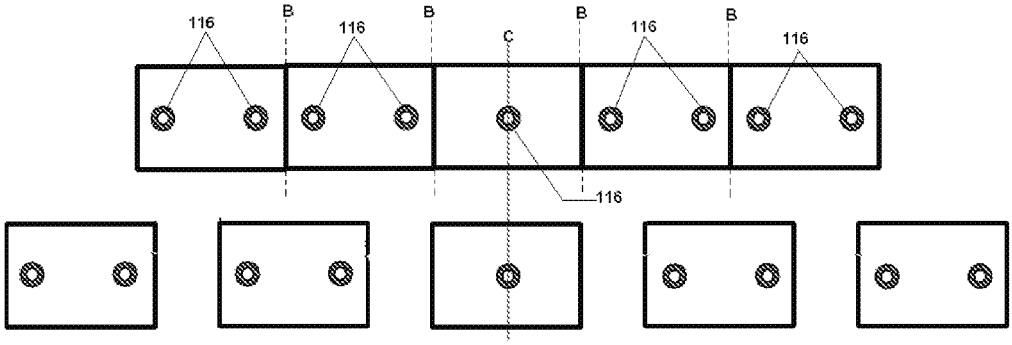

In second mode of operation as shown in FIGS. 4*b* and 4*c*, odd numbers (3 and 5) of books are conveyed in linear arrangement towards the sucker assembly (1) though the book gripping assembly (2). In this case, each said book gripping assembly (2) will place the book on the suckers such that each book (except middle book) is placed on the pair of suckers (116) whereas middle book is centrally placed on the middle sucker (116). After placing the books on the suckers (116), vacuum is generated in each sucker (including middle sucker) so that middle book is griped by middle sucker (116) and other books are gripped by their corresponding pair of suckers (116). After gripping by suckers (116), the cam operated lever (104) is operated through the cam shaft (105). Said lever (104) will linearly move said guide blocks (100, 101, 102, 103) with respect to each other by using the connecting links (107, 108) and the chain sprocket mechanism (110, 111). Along with the movement of the guide blocks (100, 101, 102, 103), each pair of sucker cups (113) and hence the pair of suckers (116) will also travel. Thus, the pairs of suckers (116) are separated from each other whereby the books gripped/sucked by said pairs are also separated from their partition line (B). Here, the middle sucker (116) will remain stationary and only pairs of sucker (116) will be moved so that the books are separated from their partition line (B) as shown in FIG. 4*b*.

Once the books are separated, the vacuum is disconnected and pressurized air will allow book to move inside the back stopper assembly (3). After separation, each pair of sucker (116) takes it original position for receiving next set of books. Said gripping assembly (2) conveys the separated book towards the back stopper assembly (3) where the book is properly positioned by the front jogger cam (302) and the side jogger cam. After positioning of books, the corner cutting of the books is carried by corner cutting assembly (4) so that multiple numbers of books are converted into round cornered mode simultaneously. Thus, the round corner cutting machine according to the present invention is configured by simplified mechanism to accommodate different size and number of books for performing the corner cutting operation.

The invention has been explained in relation to specific embodiment. It is inferred that the foregoing description is only illustrative of the present invention and it is not intended that the invention be limited or restrictive thereto. Many other specific embodiments of the present invention will be apparent to one skilled in the art from the foregoing disclosure. All substitution, alterations and modification of the present invention which come within the scope of the following claims are to which the present invention is readily susceptible without departing from the spirit of the invention. The scope of the invention should therefore be determined not with reference to the above description but should be determined with reference to appended claims along with full scope of equivalents to which such claims are entitled.

LIST OF REFERENCE NUMERALS

Book Separator Sucker Assembly (1)
Book Gripper Assembly (2)
Book Stopper Assembly (3)
Corner Cutting Assembly (4)
Sucker mounting guide blocks (100, 101, 102, 103)
Cam Operated Lever (104)
Cam shaft (105)
Eccentric Bracket (106)
Center Hole (106*a*)
Side Hole (106*b*)
Extendable Connecting Link (107, 108)
Bolts (107*a*, 108*a*)
Bolts (109)
Chain Sprocket Assembly (110, 111)
Adjustment Slot (112)
Sucker Cup (113)
Fastening Means (114)
Bolt (114*a*)
Bars (115)
Sucker (116)
Back Stopper (301)
Front Jogger Cam (302)
Top Knife and Book holder (401, 402)

I claim:

1. An improved round corner cutting machine that is configured for accommodating and separating sharp cornered bound instruction books of different size that are linearly adjacent to each other at a partition line and for round corner cutting of accommodated and separated sharp cornered books comprising:

a book separator sucker assembly for accommodating and separating the adjacent sharp cornered books from their partition line, a book gripping assembly configured for griping the book along a lateral edge and conveying the books towards the book separator assembly and a back stopper assembly, the back stopper assembly for adjusting a position of the separated sharp cornered book and a corner cutting assembly for performing corner cutting operation onto the sharp cornered books positioned by the back stopper assembly;

wherein said book separator sucker assembly includes sucker mounting guide blocks, a cam operated lever being connected to a cam shaft through an eccentric bracket, connecting links, pairs of sucker cups for gripping books, a middle sucker cup positioned on center line such that the middle sucker cup divides equal numbers of pairs of sucker cups at both sides thereof and holds middle book in case of odd numbers of books to be separated, one end of each said connecting link is connected to the lever and another end of each link is respectively connected to the guide blocks through bolts;

wherein each guide block is configured with two extended adjustment slots, each guide block is connected with the pair of sucker cups by securing the sucker cup through the adjustment slot by fastening means;

wherein each sucker cup is equipped with a sucker for griping the books;

wherein a distance between suckers of each pair is adjusted by loosening the fastening means and sliding the sucker cups within the adjustment slots;

wherein a pair of the suckers grips at least one book;

wherein two of said guide blocks are equidistantly moved in opposite direction with respect to a center line;

wherein another two of said guide blocks are equidistantly moved in opposite direction with respect to the center line;

wherein each pair of sucker travels along with the movement of corresponding guide blocks through the cam operated lever so that the books are separated from their partition line along with the separation of the pairs of suckers.

2. The improved round corner cutting machine as claimed in claim 1, wherein said pairs of sucker cups are slidably supported via a bare.

3. The improved round corner cutting machine as claimed in claim 1, wherein said connecting links are extendable whereby a position of said guide blocks is adjusted by adjusting a length of the links by loosening a first one of the bolts and a second one of the bolts.

4. The improved round corner cutting machine as claimed in claim 1, wherein each sucker is connected to a vacuum pump.

5. The improved round corner cutting machine as claimed in claim 1, wherein said middle sucker cup is firmly secured onto a bar.

6. The improved round corner cutting machine as claimed in claim 1, wherein said book stopper assembly includes a back stopper, at the back stopper the separated book is stopped, a front jogger cam and a side jogger cam.

7. The improved round corner cutting machine as claimed in claim 1, wherein the two of said guide blocks are connected with each other and the another two of said guide blocks are connected with each other through respective chain sprocket mechanisms.

8. The improved round corner cutting machine as claimed in claim 1, wherein all of said guide blocks are connected with each other through a chain sprocket mechanism.

9. A method for round corner cutting of sharp cornered bound instruction books by an improved round corner cutting machine comprising:

a) adjusting a position of guide blocks through connecting links;

b) adjusting a position of a pair of sucker cups within an adjustment slot of guide blocks such that each book is gripped by a pair of suckers;

c) conveying and placing adjacent sharp cornered books that are linearly adjacent to each other at a partition line on the pair of suckers;

d) gripping the books by generating a vacuum in the suckers by connecting the pair of suckers with a vacuum pump;

e) operating a cam operated lever through a cam shaft;

f) moving first and second ones of the guide blocks in linear direction through the connecting links along with an up and down movement of the lever;

g) moving a third one of the guide blocks in opposite linear direction with respect to the movement of the first one of the guide blocks through a first chain sprocket mechanism;

h) moving a fourth one of the guide blocks in opposite linear direction with respect to the movement of the second one of the guide blocks through a second chain sprocket mechanism;

i) moving each pair of suckers along with the movement of a corresponding guide block;

j) separating the books from the partition line along with the movement of the pairs of suckers;

k) disconnecting the vacuum pump from the pair of suckers and positioning the pair of suckers for receiving a next set of adjacent books;

l) conveying the separated books towards a book stopper assembly and adjusting each book through the books stopper assembly; and m) cutting the corner of each book in round corner mode by a corner cutting assembly.

10. The method for round corner cutting of sharp cornered bound instruction books by the improved round corner cutting machine as claimed in claim 9, wherein step d), generating a vacuum in a middle sucker for gripping middle book in case of separation of odd numbers of books and keeping a vacuum connection of the middle sucker in an OFF condition in case of separation of even books.

* * * * *